US007735344B2

(12) United States Patent
Omura et al.

(10) Patent No.: US 7,735,344 B2
(45) Date of Patent: Jun. 15, 2010

(54) DRUM TYPE WASHING MACHINE

(75) Inventors: Yuko Omura, Kyoto (JP); Hiroyuki Fujii, Hyogo (JP); Kenji Terai, Osaka (JP); Hiroko Minayoshi, Kyoto (JP)

(73) Assignee: Panasonic Corporation, Osaka (JP)

( * ) Notice: Subject to any disclaimer, the term of this patent is extended or adjusted under 35 U.S.C. 154(b) by 748 days.

(21) Appl. No.: 11/107,829

(22) Filed: Apr. 18, 2005

(65) Prior Publication Data

US 2005/0257576 A1 Nov. 24, 2005

(30) Foreign Application Priority Data

May 18, 2004 (JP) ..... 2004-147431

(51) Int. Cl.
*D06F 33/00* (2006.01)

(52) U.S. Cl. ..... 68/12.04; 68/12.05; 68/17 R; 68/207

(58) Field of Classification Search ..... 68/12.04, 68/12.05, 17 R, 24, 207
See application file for complete search history.

(56) References Cited

U.S. PATENT DOCUMENTS

| | | | | |
|---|---|---|---|---|
| 4,784,666 | A * | 11/1988 | Brenner et al. | 8/137 |
| 6,381,791 | B1 * | 5/2002 | French et al. | 8/159 |
| 6,584,811 | B2 * | 7/2003 | Whah et al. | 68/12.04 |
| 6,591,439 | B2 * | 7/2003 | Whah et al. | 8/159 |
| 7,444,842 | B2 * | 11/2008 | Kim et al. | 68/12.18 |
| 7,490,491 | B2 * | 2/2009 | Yang et al. | 68/12.05 |
| 2004/0040344 | A1 * | 3/2004 | Minayoshi et al. | 68/12.16 |
| 2005/0016227 | A1 * | 1/2005 | Lee | 68/12.04 |
| 2005/0022319 | A1 | 2/2005 | Kim et al. | |

FOREIGN PATENT DOCUMENTS

| | | |
|---|---|---|
| DE | 36 31 685 | 3/1988 |
| JP | 8-24471 | 1/1996 |
| JP | 09-215893 | 8/1997 |
| JP | 2004-8276 | 1/2004 |
| KR | 10-2005-0014506 | 2/2005 |
| WO | 03/014453 | 2/2003 |
| WO | WO 03/080916 A1 | 10/2003 |

* cited by examiner

*Primary Examiner*—Joseph L Perrin
(74) *Attorney, Agent, or Firm*—Bacon & Thomas, PLLC

(57) ABSTRACT

A drum type washing machine includes a rotary drum having an approximately horizontal or slanted rotational axis; an outer tub for accommodating the rotary drum therein; a driving motor for rotating the rotary drum; a detergent case for accommodating detergent therein; a first water supply unit for supplying water into the outer tub via the detergent case; a second water supply unit for supplying water into the rotary drum through a front opening thereof; and a controller for controlling operations of the driving motor and the first and the second water supply unit to execute a washing process during which water is supplied first up to a first water level, and the rotary drum is rotated at a first rotational speed for a time period, and then water is supplied up to a second water level, the first water level being lower than the second water level.

2 Claims, 4 Drawing Sheets

DRUM TYPE WASHING MACHINE

FIELD OF THE INVENTION

The present invention relates to a drum type washing machine for performing washing, rinsing and water-extracting processes in a rotary drum rotably disposed in an outer tub, wherein the rotational axis of the rotary drum is horizontal or slanted with respect to the horizontal direction.

BACKGROUND OF THE INVENTION

Referring to FIG. 4, there is shown a conventional drum type washing machine.

As shown therein, housing 26 of the drum type washing machine includes outer tub 27 supported on a suspension structure, and rotary drum 29 provided with multiple drum perforations 28 on its cylindrical surface is rotably disposed in outer tub 27. Rotary drum 29 is driven to rotate by driving motor 30. Further, by opening door 31 provided at the front portion of housing 26, loading and unloading of laundry into and from rotary drum 29 can be performed through front openings 27*a* and 29*a* of outer tub 27 and rotary drum 29, respectively.

If the drum type washing machine starts to operate after laundry being loaded into rotary drum 29 through opening door 31 and detergent being added thereinto, water is supplied into outer tub 27, and the water supplied in outer tub 27 is also introduced into rotary drum 29 through drum perforations 28. Then, if rotary drum 29 is rotated at a predetermined rotational speed by driving motor 30, the laundry accommodated in rotary drum 29 is lifted up by agitation blades 32 provided on the inner cylindrical surface of rotary drum 29 in the rotational direction of rotary drum 29 and then dropped down upon reaching an appropriate height. Therefore, the laundry is subject to pounding motions to be washed.

Upon the completion of such washing process, soiled water is drained and fresh water is supplied to perform a rinsing process. When the rinsing process is finished, a water-extracting process during which rotary drum 29 is rotated at a high rotational speed is executed. These processes are automatically performed in accordance with a predetermined control sequence.

In addition to the above-described general configuration of drum type washing machine, in order to improve the cleaning efficiency, there is proposed a drum type washing machine capable of drawing water supplied into the outer tub into the rotary drum sufficiently and allowing laundry to be fully soaked in the water, to thereby improve cleaning efficiency (see, for example, Japanese Patent Laid-open Application No. H9-215893, pp. 3 to 5, FIG. 1).

The conventional drum type washing machine, however, has problems in that the washing process is performed without the detergent being fully dissolved in water and without the laundry being sufficiently soaked in the water, thus failing to obtain a sufficient effect of pounding motions. As a consequence, there gives a problem of poor cleaning efficiency or consumption of a considerable amount of time prior to obtaining a desired degree of cleaning efficiency.

SUMMARY OF THE INVENTION

It is, therefore, an object of the present invention to provide a drum type washing machine capable of shortening a washing time with improved cleaning efficiency.

In accordance with a preferred embodiment of the present invention, there is provided a drum type washing machine including: a rotary drum having an approximately horizontal or slanted rotational axis; an outer tub for accommodating the rotary drum therein; a driving motor for rotating the rotary drum; a detergent case for accommodating detergent therein; a first water supply unit for supplying water into the outer tub via the detergent case; a second water supply unit for supplying water into the rotary drum through a front opening of the rotary drum, and a controller for controlling operations of the driving motor and the first and the second water supply unit to execute a washing process during which water is supplied first up to a first water level by the first water supply unit, and the rotary drum is rotated at a first rotational speed for a time period, and then water is supplied up to a second water level by the second water supply unit, the first water level being lower than the second water level.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, preferred embodiments of the present invention will be described in detail with reference to the accompanying drawings. Here, it is to be noted that the present invention is not limited thereto.

Figure 1:
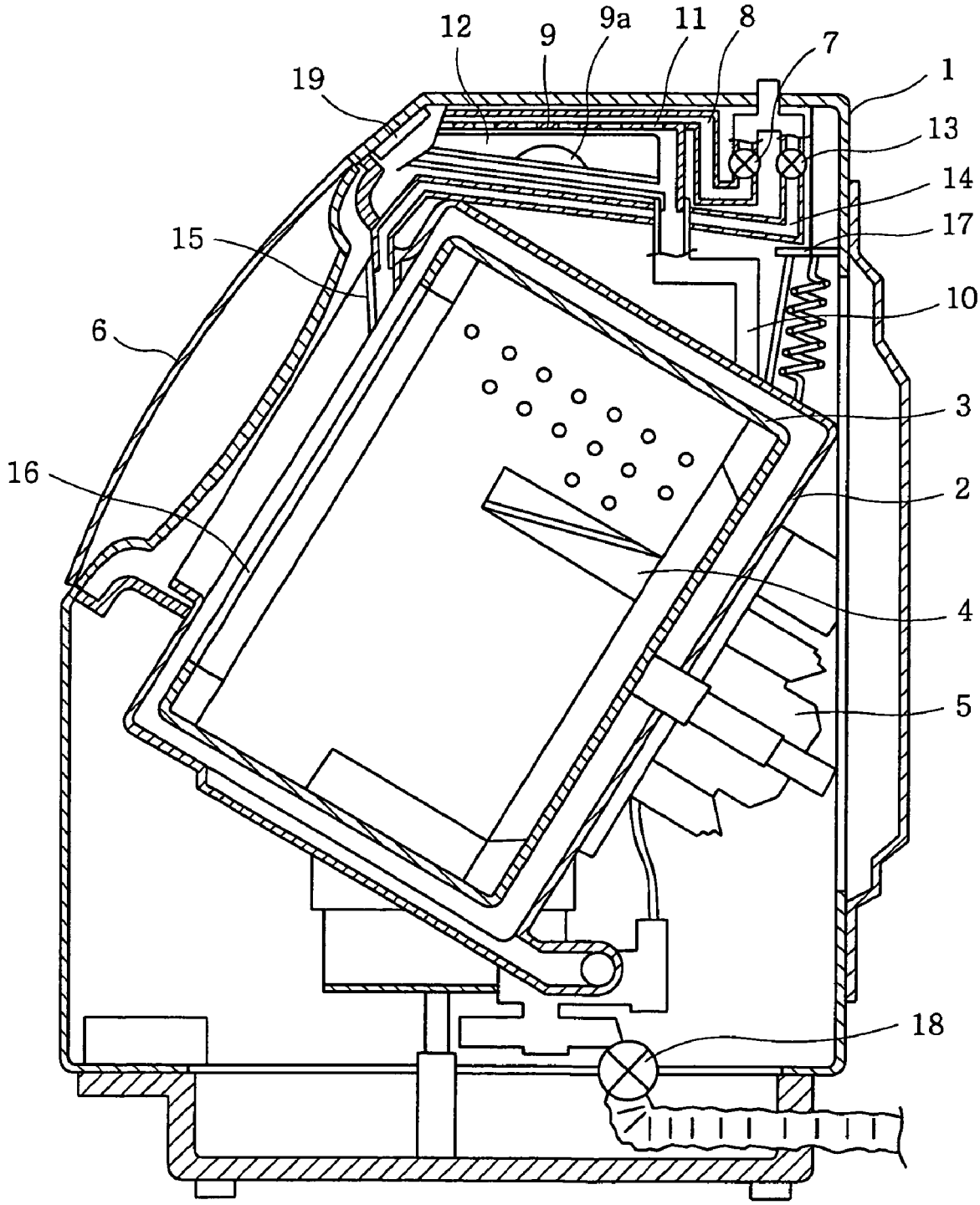
FIG. 1 is a cross sectional view of a drum type washing machine in accordance with a preferred embodiment of the present invention.
Figure 2:
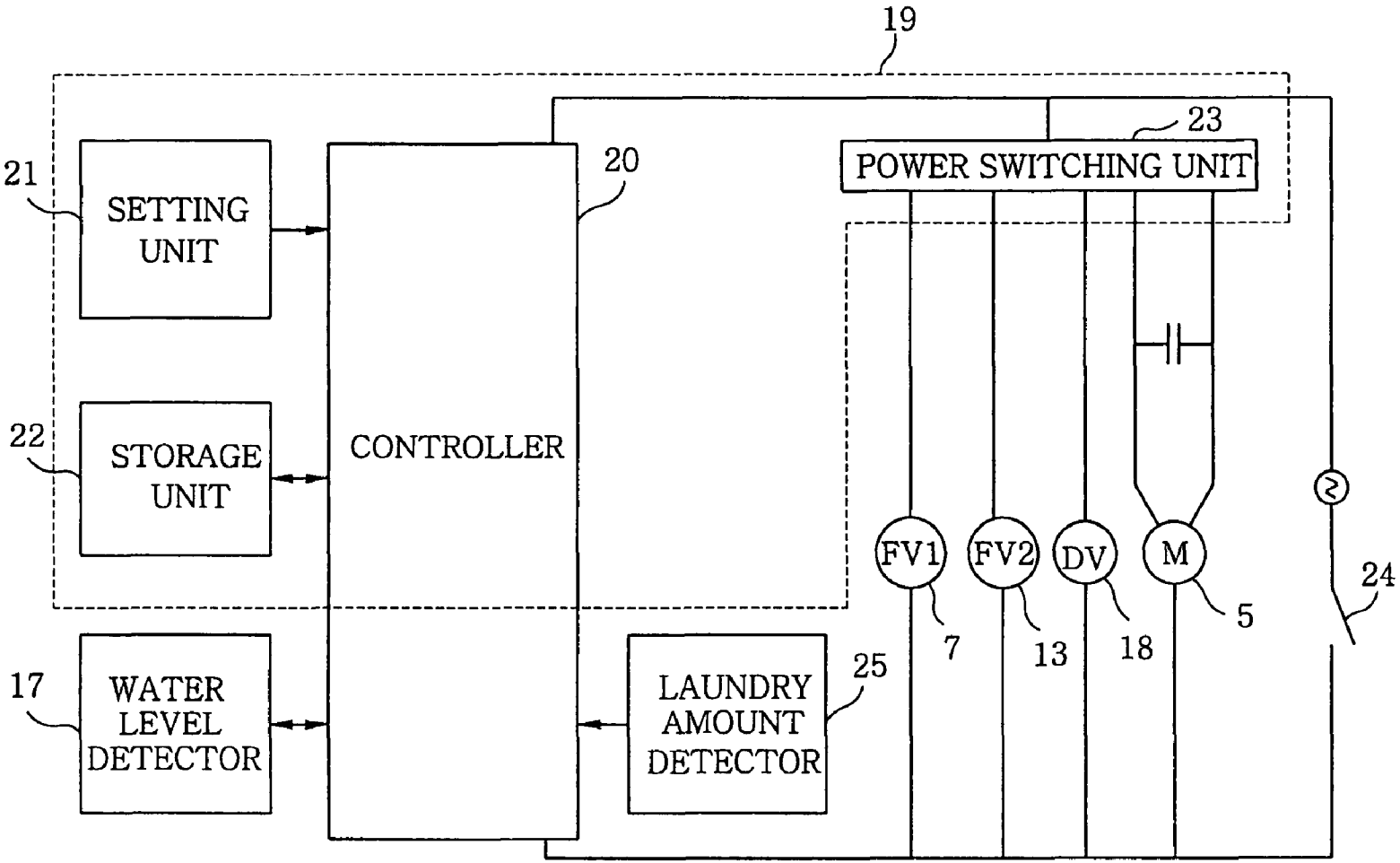
FIG. 2 sets forth a block diagram to show a configuration of a controller for use in the drum type washing machine in accordance with the preferred embodiment of the present invention.
Figure 3:
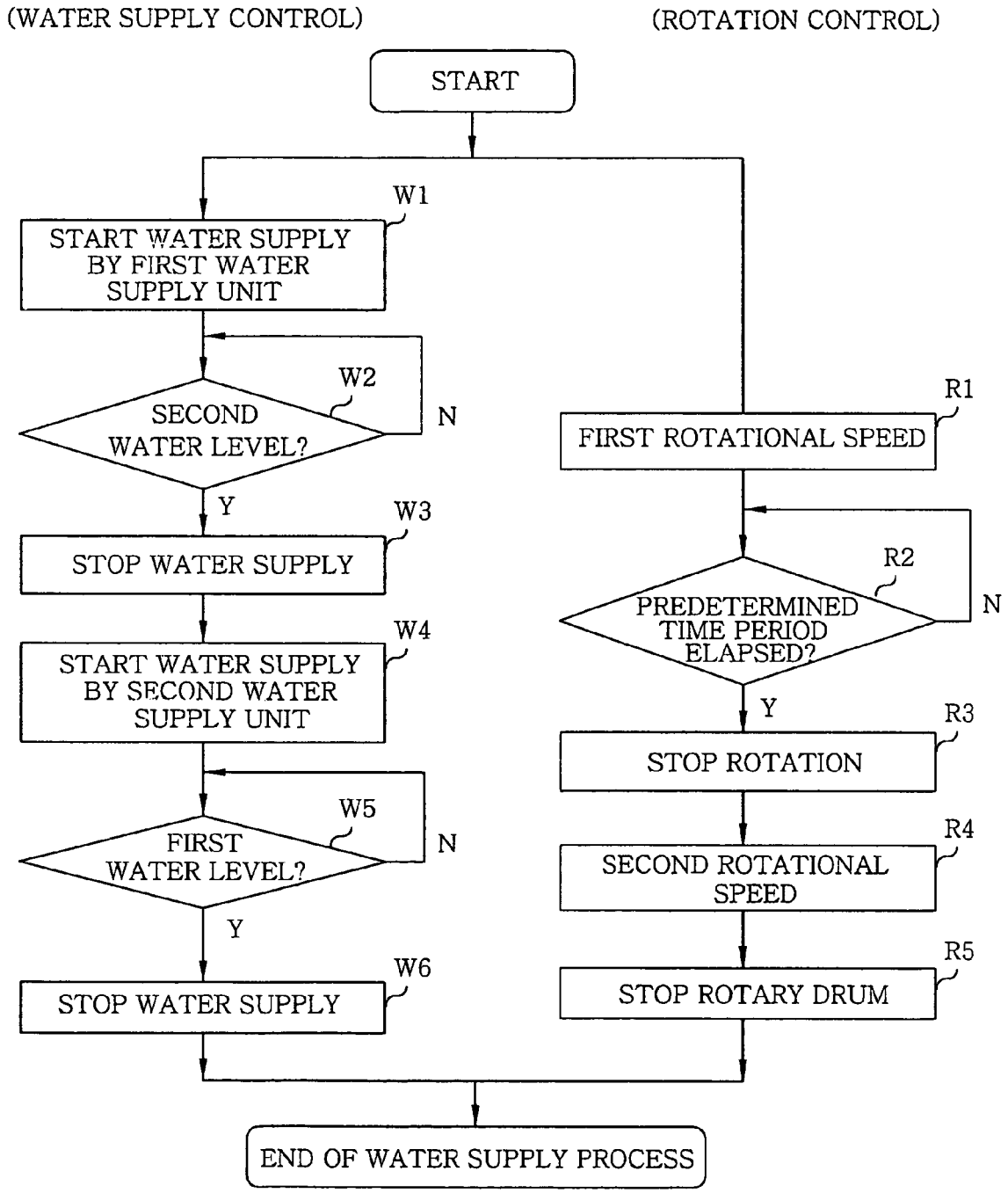
FIG. 3 presents a flow chart to describe a water supply control and a rotation control executed by the controller.
Figure 4:
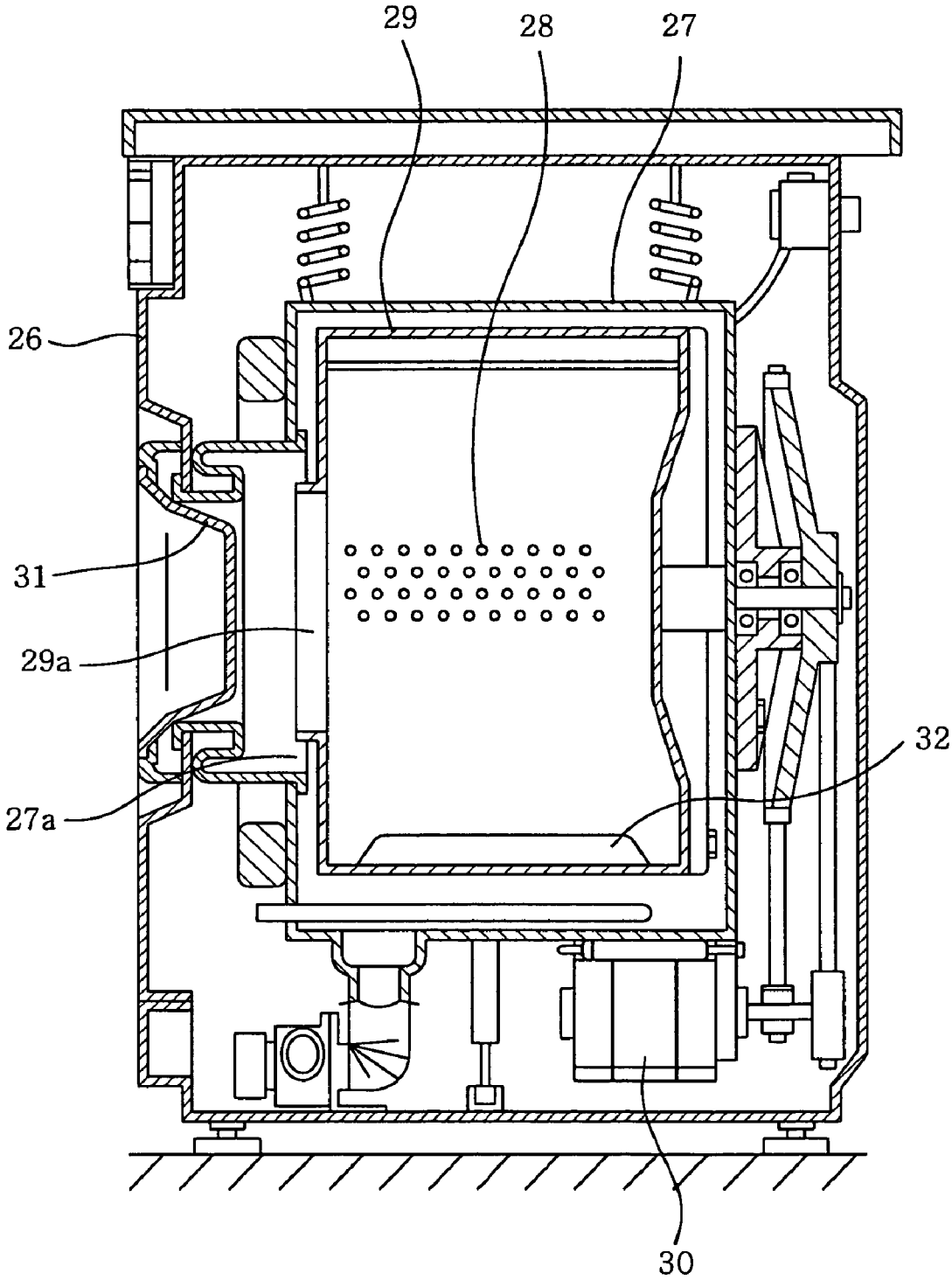
FIG. 4 (PRIOR ART)
FIG. 4 illustrates a cross sectional view of a conventional drum type washing machine.

FIG. 1 is a cross sectional view of a drum type washing machine in accordance with a preferred embodiment of the present invention and FIG. 2 sets forth a block diagram of a controller to be used therein. FIG. 3 presents a flow chart to describe the sequence of a water supply control and a rotation control executed by the controller.

Referring to FIG. 1, housing 1 of the drum type washing machine includes outer tub 2 slantingly supported on a suspension structure (not shown). Rotably installed in outer tub 2 is cylindrical rotary drum 3 having a bottom surface. Rotary drum 3 has agitation blades 4 provided on plural locations on the inner cylindrical surface thereof and is driven to rotate by driving motor 5 installed at the rear portion of outer tub 2 such that its rotational speed or rotational direction can be varied. Further, door 6 is installed at the front portion of housing 1.

First water supply hose 8 is connected at one end thereof to first water supply valve 7 serving as a first water supply unit and at the other end to detergent case 9 for accommodating detergent 9*a* therein. Further, connected to a lower portion of detergent case 9 is one end of second water supply hose 10 and the other end of second water supply hose 10 is coupled to outer tub 2, thus serving to supply water in outer tub 2.

Formed at the top surface of detergent case 9 is a plurality of water flow holes 11 communicating with first water supply hose 8, for uniformly distributing therethrough water from first water supply hose 8. The water from water flow holes 11 drops down on detergent 9*a* in detergent dispenser 12 and then flows into outer tub 2 along with detergent 9*a*. Further, coupled to second water supply valve 13 serving as a second water supply unit is one end of third water supply hose 14, and the other end of third water supply hose 14 is coupled to water flow piping 15. Water flow piping 15 is installed at the front portion of outer tub 2 and is configured to provide the laundry accommodated in rotary drum 3 with water through front opening 16 of rotary drum 3. Preferably, water flow piping 15 may be configured to spray water by using a nozzle, whereby permeation of water into the laundry can be facilitated.

The drum type washing machine in accordance with the preferred embodiment of the present invention further includes water level detector 17 for detecting a water level in outer tub 2, a water drain valve 18 for draining water from outer tub 2 to the outside, control unit 19 for controlling the operation of the washing, rinsing and water-extracting processes, and so forth. If the washing operation is started after laundry being loaded into rotary drum 3 through opening door 6 and a predetermined amount of detergent being added into detergent dispenser 12 within detergent case 9, control unit 19 controls a series of operations of the washing machine.

FIG. 2 is a block diagram showing a configuration of control unit 19 including controller 20 with a microcomputer. Controller 20 outputs a control command to power switching unit 23 by using a control program stored in storage unit 22 in response to a setting input such as a selection of an operation course inputted from setting unit 21. Power switching unit 23 made up of switching devices such as Silicon Controlled Rectifier (SCR) on-off controls driving motor 5, first water supply valve 7 serving as the first water supply unit, second water supply valve 13 serving as the second water supply unit, water drain valve 18, and so forth, in response to the control command outputted from controller 20.

Hereinafter, control operation of control unit 19 will be described with reference to FIGS. 1 to 3.

After opening door 6, laundry is put into rotary drum 3 and a specified amount of detergent is added into detergent dispenser 12 within detergent case 9. Then, power switch 24 is turned on. Thereafter, an operation course is selected from setting unit 21 on a control panel (not shown) provided on a surface of housing 1 depending on types of laundry to be washed. Upon executing an input for an operation start, controller 20 reads a control program corresponding to the setup input from storage unit 22 and initiates a control operation in accordance with a control sequence.

First, controller 20 detects the amount of the laundry in rotary drum 3 by laundry amount detector 25 while rotating rotary drum 3. Specifically, laundry amount detector 25 calculates the amount of the laundry based on variation of loads exerted on driving motor 5. The detected laundry amount is inputted to controller 20 and stored in storage unit 22. During the washing process, water is supplied in outer tub 2 up to a first water level that is determined based on the amount of the laundry detected by laundry amount detector 25.

At the beginning of the washing process, a water supplying operation is first started. During the water supplying operation, a control of water supply and a control of rotation of rotary drum 3 are executed as shown in FIG. 3, wherein reference numerals W1 to W6 represent a control sequence for the water supply control while reference numerals R1 to R5 describes a control sequence for the rotation control of rotary drum 3 and they are identical to those described in the following.

First, controller 20 outputs a control command to power switching unit 23 to open first water supply valve 7 to supply water into outer tub 2. By the control command, first water supply valve 7 serving as the first water supply unit is opened, and fresh water is fed into detergent case 9 via first water supply hose 8 which is connected to first water supply valve 7. Then, the water is uniformly dispersed in detergent dispenser 12 through the plurality of water flow holes 11 provided on the top surface of detergent case 9. At this time, detergent 9*a* in detergent dispenser 12 is also flown into outer tub 2 via second water supply hose 10 connected to the lower portion of detergent case 9 by being mixed with the water (W1).

When water level detector 17 detects that the water level in outer tub 2 has reached a second water level (W2), which is lower than the first water level during the washing process, controller 20 outputs a control command to power switching unit 23 to close first water supply valve 7, to thereby stop the supply of water (W3).

Thereafter, controller 20 outputs a control command to driving motor 5 to rotate rotary drum 3 at a first rotational speed, so that rotary drum 3 is rotated at the first rotational speed that is greater than a second rotational speed to be described later (R1). The first rotational speed is a rotational speed fast enough to make the laundry cling to the inner cylindrical surface of rotary drum 3 without falling down by the centrifugal force generated by the rotation of rotary drum 3. The first rotational speed is, for example, about 90 to 140 r/min when the diameter of rotary drum 3 is about 500±50 mm.

Further, by rotating rotary drum 3 at the first rotational speed while setting the second water level just high enough to allow the lowermost portion of rotary drum 3 to be submerged in the water, there is developed a fast current in the water and the detergent supplied in outer tub 2, so that the detergent can be dissolved in the water efficiently and rapidly.

After a lapse of a predetermined time period long enough to allow the detergent in outer tub 2 to be fully dissolved in the water (R2), controller 20 outputs a control command to driving motor 5 to stop the rotation of rotary drum 3, so that rotary drum 3 is stopped (R3).

Then, controller 20 outputs a control command to power switching unit 23 to open second water supply valve 13, which serves as the second water supply unit, to supply fresh water into outer tub 2 and to rotate rotary drum 3 at the second rotational speed. By the control command, second water supply valve 13 serving as the second water supply unit is opened, so that fresh water is fed into rotary drum 3 from water flow piping 15 (W4) after flowing through third water supply hose 14. Simultaneously with the supply of water, rotary drum 3 is rotated at the second rotational speed by driving motor 5 (R4).

The second rotational speed is a rotational speed allowing the laundry accommodated in rotary drum 3 to be lifted up in the rotational direction of rotary drum 3 and drop down upon reaching a certain height where the weight of the laundry becomes greater than the inertia or the centrifugal force exerted on it by the rotation of rotary drum 3. The second rotational speed is about 35±5 r/min when the diameter of rotary drum 3 is about 500±50 mm. By controlling the rotation of driving motor 5 to obtain the second rotational speed, the above-described lift-up and drop movements of the laundry can be obtained.

As described, agitation blades 4 are provided on the plural locations on the inner cylindrical surface of rotary drum 3. When rotary drum 3 is rotated at the second rotational speed, the laundry being in contact with the inner cylindrical surface of rotary drum 3 is lifted up in the rotational direction by being caught by agitation blades 4. Since the laundry piled in rotary drum 3 is successively moved up and dropped when it reaches the height where its weight becomes greater than the inertia or the centrifugal force produced by the rotation of rotary drum 3. Therefore, the position of the laundry is changed, and the water fed into rotary drum 3 from water flow piping 15 can be rapidly supplied to all over the laundry, while soaking the laundry. Further, an effect of pounding motions can be obtained at an earlier stage with the laundry sufficiently soaked in the water.

The water level in outer tub 2 is detected by water level detector 17 disposed in outer tub 2. When the water level reaches the first water level (W5), the water level detector 17 inputs a detection output to controller 20. Then, controller 20 outputs a control command to power switching unit 23 to close second water supply valve 13 serving as the second water supply unit to thereby stop the supply of water. As a consequence, the water supply is ceased (W6). Concurrently, controller 20 outputs a control command to driving motor 5 to stop the rotation of rotary drum 3, whereby rotary drum 3 is stopped (R5).

After the completion of the water supplying operation, washing, rinsing and water-extracting processes are carried out, and then the whole process is terminated. Since the washing, the rinsing and the water-extracting processes are identical to those generally known in the prior art, explanation thereof will be omitted.

By setting the second water level to be at the level allowing the lowermost portion of rotary drum 3 to be submerged in water, the amount of water supplied toward the inside of rotary drum 3 from the front opening thereof increases, so that the laundry can be rapidly soaked in the water and the effect of pounding motions can be obtained at an earlier stage, resulting in enhancement of cleaning efficiency.

Moreover, though the first water level in outer tub 2 is determined based on the amount of laundry detected by laundry amount detector 25 in the preferred embodiment of the present invention, it is also possible to fix it at a specified level or to allow user to select one among a plurality of preset water levels depending on the amount of laundry, for example, depending on whether the laundry amount is great or small.

Though the preferred embodiment of the present invention has been described for the case of slantingly disposing rotary drum 3, the same effect can be obtained with rotary drum 3 horizontally disposed by varying the rotational speed thereof.

As described above, in accordance with the preferred embodiment of the present invention, since the rotary drum is rotated after the detergent and the water is supplied in the outer tub, the detergent can be rapidly dissolved. Further, since water is supplied toward the inside of the rotary drum from the front opening thereof, the laundry can be rapidly soaked in the water and the effect of pounding motions can be obtained at an earlier stage. In addition, it is not limited to the washing machine but it can be applied to equipments and apparatuses performing a washing process and other processes by dissolving powder or granule in liquid.

The drum type washing machine in accordance with the present invention is capable of increasing the speed at which detergent is dissolved in water and the speed at which laundry is soaked in the water. Therefore, cleaning efficiency can be improved and washing time can be reduced.

While the invention has been shown and described with respect to the preferred embodiments, it will be understood by those skilled in the art that various changes and modifications may be made without departing from the spirit and scope of the invention as defined in the following claims.

What is claimed is:

1. A drum type washing machine comprising:

a rotary drum having an approximately horizontal or slanted rotational axis;

an outer tub for accommodating the rotary drum therein;

a driving motor for rotating the rotary drum;

a detergent case for accommodating detergent therein;

a first water supply unit for supplying water into the outer tub via the detergent case;

a second water supply unit for supplying water into the rotary drum through a front opening of the rotary drum; and a controller configured to control operations of the driving motor and the first and the second water supply unit to execute a washing process such that water and detergent are supplied first up to a first water level by the first water supply unit, supplying the water by the first water supply unit is then stopped when a water level reaches the first water level which is just high enough to allow the lowermost portion of the rotary drum to be submerged, the rotary drum is subsequently rotated at a first rotational speed for a time period after supplying the water by the first water supply unit is stopped thereby providing a fast current to dissolve the detergent, and water is then supplied up to a second water level by the second water supply unit, wherein the first water level is lower than the second water level and the second water level is determined by detecting an amount of laundry with a laundry amount detector or by user's manual setting, wherein the first rotational speed exerts a centrifugal force that makes laundry accommodated in the rotary drum cling to an inner cylindrical surface of the rotary drum without falling down, wherein the rotary drum is rotated at a second rotational speed while supplying the water up to the second water level by the second water supply unit, and wherein the second rotational speed represents a rotational speed allowing the laundry accommodated in the rotary drum to be lifted up by the rotation of the rotary drum and drop down by gravity.

2. The washing machine of claim 1, wherein the diameter of the rotary drum is in the range of about 450 to about 550 mm and the first rotational speed is in the rage of about 90 to about 140r/min.

* * * * *